US011085144B2

(12) United States Patent
Kang et al.

(10) Patent No.: US 11,085,144 B2
(45) Date of Patent: Aug. 10, 2021

(54) WASHING MACHINE AND CONTROL METHOD THEREFOR

(71) Applicant: SAMSUNG ELECTRONICS CO., LTD., Suwon-si (KR)

(72) Inventors: Min-hee Kang, Suwon-si (KR); Sung-gyu Shin, Seoul (KR); Hong-yeol Lee, Yongin-si (KR); Hyung-sub Lim, Suwon-si (KR); Seung-hun Choi, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 51 days.

(21) Appl. No.: 16/492,772

(22) PCT Filed: Mar. 9, 2018

(86) PCT No.: PCT/KR2018/002859
§ 371 (c)(1),
(2) Date: Sep. 10, 2019

(87) PCT Pub. No.: WO2018/164548
PCT Pub. Date: Sep. 13, 2018

(65) Prior Publication Data

US 2020/0071873 A1 Mar. 5, 2020

(30) Foreign Application Priority Data

Mar. 10, 2017 (KR) ..... 10-2017-0030556

(51) Int. Cl.
*D06F 58/30* (2020.01)
*D06F 25/00* (2006.01)
(Continued)

(52) U.S. Cl.
CPC ..... *D06F 58/30* (2020.02); *D06F 25/00* (2013.01); *D06F 58/22* (2013.01);
(Continued)

(58) Field of Classification Search
CPC ..... D06F 58/30; D06F 58/22; D06F 25/00; D06F 2103/00; D06F 2103/34;
(Continued)

(56) References Cited

U.S. PATENT DOCUMENTS 3,959,891 A * 6/1976 Burkall ..... D06F 58/22 34/82
4,314,409 A * 2/1982 Cartier ..... D06F 58/22 34/604
(Continued)

FOREIGN PATENT DOCUMENTS

EP 2868792 7/2019
JP 2008-148926 7/2008
(Continued)

OTHER PUBLICATIONS

US 8,826,563 B2, 09/2014, Kim et al. (withdrawn)
(Continued)

*Primary Examiner* — Stephen M Gravini
(74) *Attorney, Agent, or Firm* — Staas & Halsey LLP

(57) ABSTRACT

A washing machine and a control method therefor are disclosed. The washing machine according to the present invention comprises: a drum for receiving laundry; a drying unit for adjusting the temperature of air in the drum so as to dry the laundry; a filter unit for filtering lint generated from the laundry; a cleaning unit for cleaning the filter unit; and a control unit for controlling the cleaning unit such that the filter unit is periodically cleaned during rotation of the drum. Accordingly, the washing machine can reduce the amount of lint generated from laundry during a drying process. Further, the washing machine according to the disclosure periodically cleans a filter for filtering lint generated from laundry, so as to facilitate circulation of air in the drum during a drying process, thereby improving the drying efficiency.

3 Claims, 12 Drawing Sheets

(51) Int. Cl.

| | |
|---|---|
| ***D06F 58/22*** | (2006.01) |
| ***D06F 105/46*** | (2020.01) |
| ***D06F 103/00*** | (2020.01) |
| ***D06F 103/34*** | (2020.01) |
| ***D06F 103/44*** | (2020.01) |
| ***D06F 105/24*** | (2020.01) |
| ***D06F 103/36*** | (2020.01) |

(52) U.S. Cl.
CPC ..... *D06F 2103/00* (2020.02); *D06F 2103/34* (2020.02); *D06F 2103/36* (2020.02); *D06F 2103/44* (2020.02); *D06F 2105/24* (2020.02); *D06F 2105/46* (2020.02)

(58) Field of Classification Search
CPC ..... D06F 2103/36; D06F 2103/44; D06F 2105/24; D06F 2105/46
USPC ..... 34/595–610
See application file for complete search history.

(56) References Cited

U.S. PATENT DOCUMENTS

| | | | | |
|---|---|---|---|---|
| 8,201,345 | B2 * | 6/2012 | Dalton | D06F 58/30 34/389 |
| 8,789,287 | B2 | 7/2014 | Kim et al. | |
| 8,869,421 | B2 | 10/2014 | Kim et al. | |
| 9,650,735 | B2 | 5/2017 | Doh et al. | |
| 9,797,080 | B2 | 10/2017 | Doh et al. | |
| 9,896,797 | B2 * | 2/2018 | Shin | D06F 58/02 |
| 9,982,384 | B2 * | 5/2018 | Shin | D06F 58/20 |
| 10,280,553 | B2 * | 5/2019 | Shin | D06F 58/02 |
| 2007/0163095 | A1 * | 7/2007 | McAllister | D06F 58/203 28/100 |
| 2017/0350064 | A1 * | 12/2017 | Shin | D06F 58/24 |
| 2020/0071873 | A1 * | 3/2020 | Kang | D06F 58/30 |

FOREIGN PATENT DOCUMENTS

| | | | | |
|---|---|---|---|---|
| JP | 4307105 | | 5/2009 | |
| KR | 2002-0060360 | | 7/2002 | |
| KR | 10-0562555 | | 3/2006 | |
| KR | 10-2006-0040814 | | 5/2006 | |
| KR | 10-2010-0064580 | | 6/2010 | |
| KR | 10-2012-0009086 | | 2/2012 | |
| KR | 10-2013-0114780 | | 10/2013 | |
| KR | 10-2015-0050856 | | 5/2015 | |
| WO | WO-2018164548 | A1 * | 9/2018 | D06F 58/30 |

OTHER PUBLICATIONS

International Search Report dated Jun. 27, 2018 from International Patent Application No. PCT/KR2018/002859, 3 pages.
Written Opinion of the International Searching Authority dated Jun. 27, 2018 from International Patent Application No. PCT/KR2018/002859, 13 pages.

* cited by examiner

100

| WEIGHT (kg) | CLASSIFICATION | AMOUNT OF LINT (g) | IMPROVEMENT RESULT | PICTURES OF LINT | |
|---|---|---|---|---|---|
| | | | AMOUNT OF LINT | ORIGINAL | IMPROVED |
| 1 | ORIGINAL | 0.21 | -0.11g 52.4%▼ |  |  |
| | CHANGED | 0.10 | | | |
| 2 | ORIGINAL | 0.24 | -0.11g 45.8%▼ |  |  |
| | CHANGED | 0.13 | | | |
| 3 | ORIGINAL | 0.62 | -0.3g 48.4%▼ |  |  |
| | CHANGED | 0.32 | | | |
| 5 | ORIGINAL | 0.80 | -0.5g 62.5%▼ |  |  |
| | CHANGED | 0.30 | | | |
| 7 & 8 | ORIGINAL | 0.32 | -0.13g 40.6%▼ |  |  |
| | CHANGED | 0.19 | | | |
| 9 & 12 | ORIGINAL | 0.20 | -0.07g 35%▼ |  |  |
| | CHANGED | 0.13 | | | |

WASHING MACHINE AND CONTROL METHOD THEREFOR

CROSS-REFERENCE TO RELATED APPLICATIONS

This application is a U.S. National Stage Application which claims the benefit under 35 U.S.C. § 371 of International Patent Application No. PCT/KR2018/002859 filed on Mar. 9, 2018, which claims foreign priority benefit under 35 U.S.C. § 119 of Korean Patent Application No. 10-2017-0030556 filed on Mar. 10, 2017 in the Korean Intellectual Property Office, the contents of both of which are incorporated herein by reference.

TECHNICAL FIELD

The disclosure relates to a washing machine and a control method therefor, and more particularly, to a washing machine capable of drying laundry and a control method therefor.

BACKGROUND ART

Generally, a drum-type washing machine washes laundry through a washing process of washing the laundry, a rinsing process of rinsing the washed laundry, a spin-drying process of spin-drying the laundry, and a drying process of drying the spin-dried laundry.

Particularly, in the drying process, the washing machine dries the laundry by transferring heated air to the inside of a drum while rotating the drum in which the laundry is received. At this time, the washing machine may rotate the drum while changing a rotation speed of the drum in stages. For example, the washing machine may dry the laundry while repeatedly changing the rotation speed of the drum to 40 rpm, 50 rpm, 80 rpm, and 40 rpm in this order during the drying process.

Meanwhile, once the laundry is dried to some extent or more by the heated air and the rotation of the drum, foreign matter such as lint is generated from the laundry received in the drum due to friction between the laundry and an inner wall of the drum, friction between the laundry, and the like.

Therefore, when the laundry received in the drum is taken out after the drying process is terminated, a large amount of lint generated from the laundry remains in the drum or remains on the dried laundry, which is problematic.

Meanwhile, part of lint generated during the drying process is filtered by a lint filter positioned between the drum and a drying unit which sucks air in the drum, heats the sucked air, and transfers the heated air to the drum. However, in a case where a large amount of lint is filtered by the lint filter, the lint filter is clogged by the lint filtered thereby, such that the air in the drum may not be smoothly circulated between the drum and the drying unit which heats the air and transfers the heated air. As a result, drying efficiency deteriorates.

DISCLOSURE

Technical Problem

An object of the disclosure is to reduce the amount of lint generated from laundry during a drying process.

Another object of the disclosure is to periodically clean a filter filtering lint generated from laundry, to facilitate circulation of air in a drum during a drying process.

Technical Solution

According to an embodiment of the disclosure, a washing machine includes: a drum configured to receive laundry; a drying unit configured to adjust a temperature of air in the drum to dry the laundry; a filter unit configured to filter lint generated from the laundry; a cleaning unit configured to clean the filter unit; and a control unit configured to control the cleaning unit to periodically clean the filter unit during rotation of the drum.

The control unit may control the cleaning unit to periodically clean the filter unit from a point in time at which a predetermined first threshold time elapses after a drying process starts.

The control unit may control the cleaning unit to periodically clean the filter unit from the point in time at which the first threshold time elapses until a point in time at which a predetermined second threshold time elapses.

The washing machine may further include: a driving unit configured to rotate the drum, wherein once the drying process starts, the control unit may control the driving unit to rotate at a first rotation speed during a first interval in an entire interval for the drying process and rotate at a second rotation speed higher than the first rotation speed during a second interval in the entire interval according to a dried state of the laundry.

The first threshold time may be an interval of time within the first interval and the second threshold time may be an interval of time within the second interval.

The first rotation speed may be 45 rpm and the second rotation speed may be 60 rpm.

The control unit may control the driving unit to rotate at a third rotation speed higher than the second rotation speed during a cleaning interval during which the filter unit is cleaned.

The drying unit may further include a suction unit sucking the air in the drum; and a heater unit heating the sucked air, and the control unit may control the drying unit such that at least one of the suction unit or the heater unit is turned off during a cleaning interval during which the filter unit is cleaned.

The cleaning unit may include a spray nozzle spraying cleaning water to the filter unit; and a cleaning water supply tube supplying the cleaning water to the spray nozzle.

According to another embodiment of the disclosure, a control method for a washing machine includes: rotating a drum in which laundry is received, once a drying process starts; adjusting a temperature of air in the drum to dry the laundry; and periodically cleaning a filter unit configured to filter lint generated from the laundry during rotation of the drum.

In the cleaning, the filter unit may be cleaned from a point in time at which a predetermined first threshold time elapses after the drying process starts.

In the cleaning, the filter unit may be periodically cleaned from the point in time at which the first threshold time elapses until a point in time at which a predetermined second threshold time elapses.

In the rotating, once the drying process starts, the drum may rotate at a first rotation speed during a first interval in an entire interval for the drying process and rotate at a second rotation speed higher than the first rotation speed during a second interval in the entire interval according to a dried state of the laundry.

The first threshold time may be an interval of time within the first interval and the second threshold time may be an interval of time within the second interval.

The first rotation speed may be 45 rpm and the second rotation speed may be 60 rpm.

In the rotating, the drum may rotate at a third rotation speed higher than the second rotation speed during a cleaning interval during which the filter unit is cleaned.

In the adjusting, the temperature of the air in the drum may be adjusted by heating the air sucked from the inside of the drum through a suction unit, using a heater unit, and at least one of the suction unit and the heater unit may be turned of during cleaning of the filter unit.

Advantageous Effects of Disclosure

As described above, according to the disclosure, the washing machine can reduce the amount of lint generated from laundry during the drying process. Further, the washing machine according to the disclosure periodically cleans a filter filtering lint generated from laundry, to facilitate circulation of air in the drum during a drying process, thereby improving the drying efficiency.

BEST MODE

Figure 1:
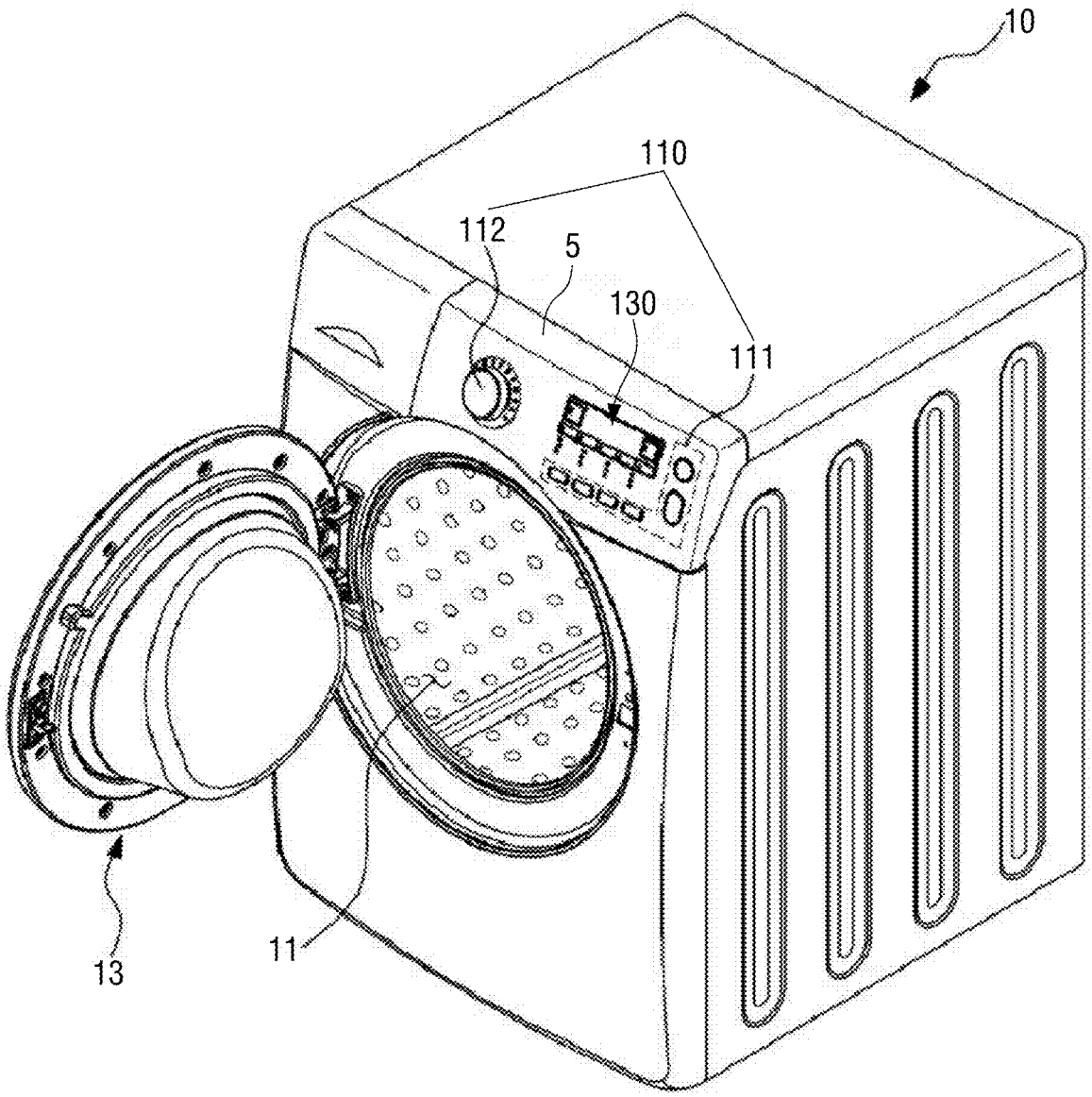
FIG. 1 is a perspective view illustrating an appearance of a washing machine according to an embodiment of the disclosure.

Hereinafter, various embodiments of the disclosure will be described with reference to the accompanying drawings. However, it is to be understood that technologies mentioned in the disclosure are not limited to specific embodiments, but include various modifications, equivalents, and/or substitutions according to embodiments of the disclosure. Throughout the accompanying drawings, similar components will be denoted by similar reference numerals.

In addition, expressions "first", "second", or the like, used in the disclosure may indicate various components regardless of a sequence and/or importance of the components, will be used only to distinguish one component from the other components, and do not limit the corresponding components. For example, a 'first portion' and a 'second portion' may indicate different portions regardless of a sequence or importance. For example, a first component may be named a second component and the second component may also be similarly named the first component, without departing from the scope of the disclosure.

Terms used in the disclosure may be used only to describe specific embodiments rather than restricting the scope of other embodiments. Singular forms may include plural forms unless the context clearly indicates otherwise. Terms used in the specification including technical and scientific terms have the same meanings as those that are generally understood by those skilled in the art to which the disclosure pertains. Terms defined by a general dictionary among terms used in the disclosure may be interpreted as meaning that are the same as or similar to meanings within a context of the related art, and are not interpreted as ideal or excessively formal means unless clearly defined in the disclosure. In some cases, terms may not be interpreted to exclude embodiments of the disclosure even though they are defined in the disclosure.

Figure 2:
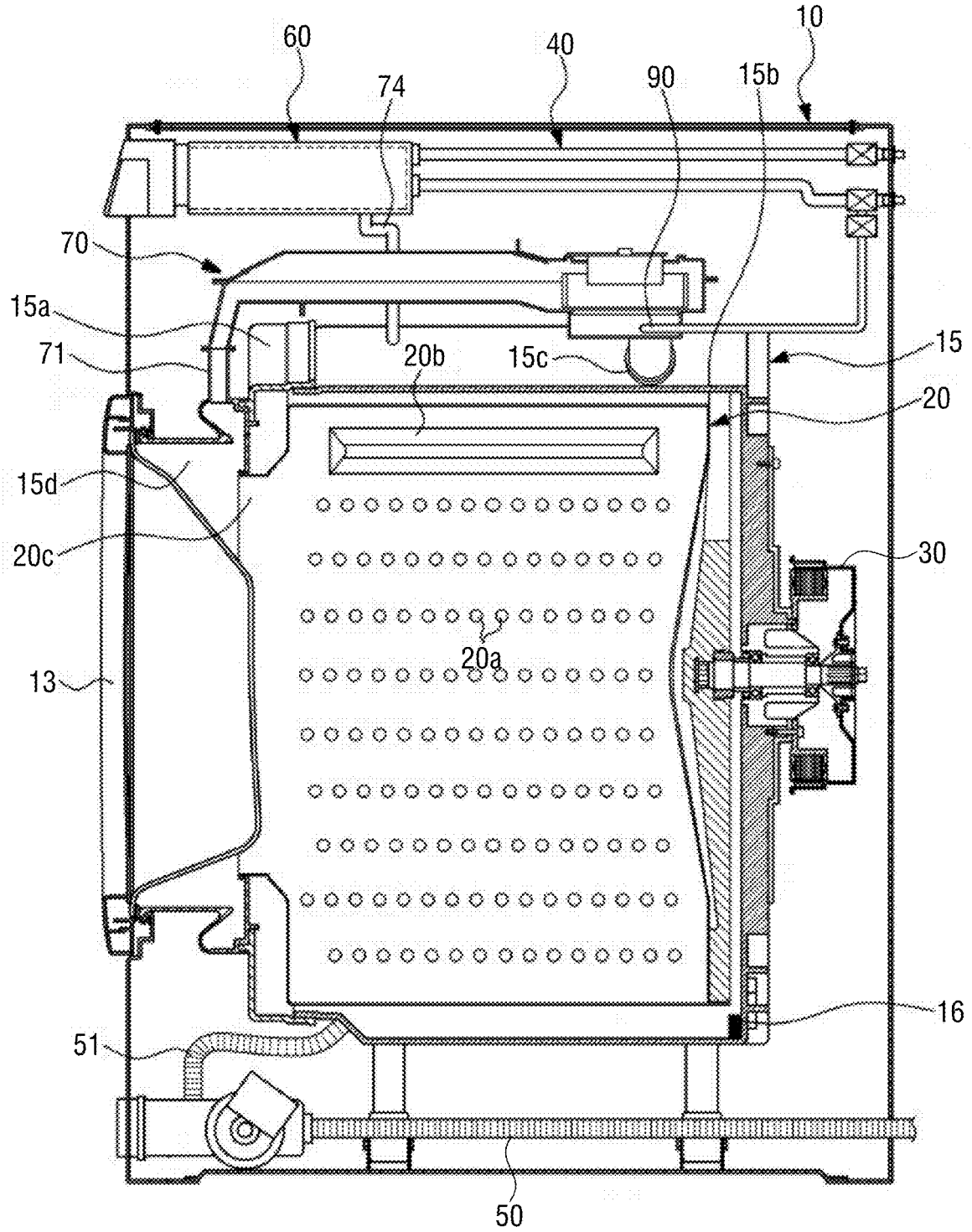
FIG. 2 is a side cross-sectional view illustrating an inside of the washing machine according to an embodiment of the disclosure.

FIG. 1 is a perspective view illustrating an appearance of a washing machine according to an embodiment of the disclosure, and FIG. 2 is a side cross-sectional view illustrating an inside of the washing machine according to an embodiment of the disclosure.

As illustrated in FIGS. 1 and 2, a washing machine 100 includes a main body 10, a tub 15 receiving water used for washing, a drum 20 which may receive laundry and rotates to wash the laundry, a driving unit 30 rotating the drum 20, a water supply unit 40 supplying the water to the tub 15, a water drainage unit 50 draining the water received in the tub 15 to the outside of the washing machine 100, a detergent supply unit 60 supplying detergent, a drying unit 70 adjusting a temperature of air in the drum 20 to dry the laundry received in the drum 20, a filter unit 80 filtering lint generated from the laundry received in the drum 20, and a cleaning unit 90 cleaning the filter unit 80.

Here, the lint may be fibers generated due to friction between the laundry caused by the rotation of the drum 20 in a process of drying the laundry received in the drum 20 by rotating the drum 20 during a drying process.

Further, the washing machine 100 includes a control unit 120 which controls overall operation with respect to the respective components for washing and drying the laundry received in the drum 20 as described above.

A loading opening 11 for loading or taking out the laundry into or from the drum 20 is formed at the center of a front surface of the main body 10, and a door 13 for opening and closing the loading opening 11 is provided on the loading opening 11. Such a door 13 is mounted on the main body 10 to be rotatable by a hinge, and may be formed so as not to be easily opened after closing the loading opening 11, by using a hook.

Further, a control panel 5 including an input unit 110 receiving a user command related to washing and a display unit 130 displaying information regarding an operation related to washing is disposed at an upper portion of the front surface where the loading opening 11 is formed. However, the disclosure is not limited thereto, and the control panel 5 including the input unit 110 and the display unit 130 may be disposed at a side portion or a lower portion of the front surface, or may be disposed in a portion of an upper surface, a left surface, or a right surface of the main body 10.

Specifically, the input unit 110 may be an input device which receives a user command related to an operation of the washing machine 100, such as a washing time, the number of times of rinsing, a spin-drying time, a drying time, a start, a pause, or the like. Such an input unit 110 may include a touch input unit 111 receiving a touch command from a user, and a controlling unit 112 receiving a control command of the user.

The display unit 130 displays an amount of laundry, washing and drying processes, water temperature information, rinsing information, a spin-drying intensity, a washing time information, and the like. Such a display unit 130 may be implemented by a liquid crystal display (LCD) panel, a light emitting diode (LED) panel, or the like.

Meanwhile, the touch input unit 111 described above may be implemented by a touch pad having an interlayer structure with the display unit 130, and in this case, the touch input unit 111 and the display unit 130 may be implemented in a form of a touch screen.

The tub 15 is provided in the main body 10 and includes a back tub member 15*b* having a shape of a cylinder with a closed back surface, and a front tub member 15*a* disposed in front of the back tub member 15*b*. Further, the driving unit 30 for rotating the drum 20 is provided behind the back tub member 15*b*.

According to an embodiment, the driving unit 30 may include a driving motor rotating the drum 20, a driving shaft which connects the drum 20 and the driving motor to each other and rotates by the driving motor, and a bearing housing rotatably supporting the driving shaft. In this case, the drum 20 may rotate around the driving shaft which rotates by the driving motor.

According to an embodiment, the driving motor may be implemented by a brushless direct current (BLDC) motor which is easily controlled in rotation speed, a synchronous alternating current (AC) motor, or the like.

Meanwhile, the drying unit 70, the filter unit 80, the cleaning unit 90, and a guide tube 15*c* for guiding the air in the tub 15 and the drum 20 toward the drying unit 70 are provided at an upper side of the back tub member 15*b*. Further, an opening 15*d* for loading or taking out the laundry into or from the drum 20 is provided at a front surface of the front tub member 15, and the drying unit 70 for transferring the air introduced through the guide tube 15*c* to the inside of the tub 15 and the drum 20 is provided above the opening 15*d*.

Further, a temperature sensor 16 detecting an internal temperature of the tub 15 may be provided in the tub 15. The tub 15 may be connected to the water supply unit 40 and the detergent supply unit 60 through a connection tube 74 provided at the upper side of the tub 15 to receive cleaning water and the detergent. Further, the tub 15 may be connected to the water drainage unit 50 through a drainage tube 51 provided at a lower side of the tub 15 to drain wash water received in the tub 15 to the outside of the washing machine 100.

The drum 20 is provided rotatably in the tub 15 and includes a plurality of through-holes 20*a* for introducing wash water received in the tub 15 into the drum 20, a lifter 20*b* for lifting the wash water introduced into the drum 20 upward, and an opening 20*c* for draining the wash water introduced into the drum 20.

The water supply unit 40 is provided above the tub 15 and transfers, to the detergent supply unit 60, wash water supplied from a water supply source (not illustrated) through a water supply tube. That is, the water supply unit 40 may receive the wash water supplied from the water supply source (not illustrated) through the water supply tube by opening a water supply valve provided at one side of the water supply tube according to a control command of the control unit 120 to be described later. Here, the water supply valve may be implemented by a solenoid valve according to an embodiment. The wash water supplied through the water supply unit 40 is introduced into the detergent supply unit 60 and detergent supplied to the detergent supply unit 60 may be supplied to the inside of the tub 15 through the connection tube 74 together with the wash water introduced into the detergent supply unit 60.

The water drainage unit 50 is provided at the lower side of the tub 15 and drains, to the outside of the main body 10 through a drainage hose, the wash water in the tub 15 pumped through a drainage pump.

The drying unit 70 is provided at the upper side of the tub 15 and dries the laundry received in the drum 20 during the drying process. Specifically, the drying unit 70 sucks the air in the tub 15 and the drum 20, heats the sucked air, and discharges the heated air to the tub 15 and the drum 20.

The filter unit 80 is provided between the drying unit 70 and the tub 15, and filters foreign matter including the lint to prevent the foreign matter including the lint from being sucked into the drying unit 70 in a process in which the air in the tub 15 and the drum 20 is sucked into the drying unit 70 during the drying process, the lint being generated from the laundry received in the drum 20.

Further, the cleaning unit 90 periodically cleans the filter unit 80 during the drying process to remove the foreign matter including the lint, which is filtered by the filter unit 80. As such, the filter unit 80 is periodically cleaned by the cleaning unit 90, and as a result, it is possible to resolve the problem that drying efficiency deteriorates, which is caused because the air in the tub 15 and the drum 20 is not transferred to the drying unit 70 due to the foreign matter including the lint, which is filtered by the filter unit 80.

Figure 3:
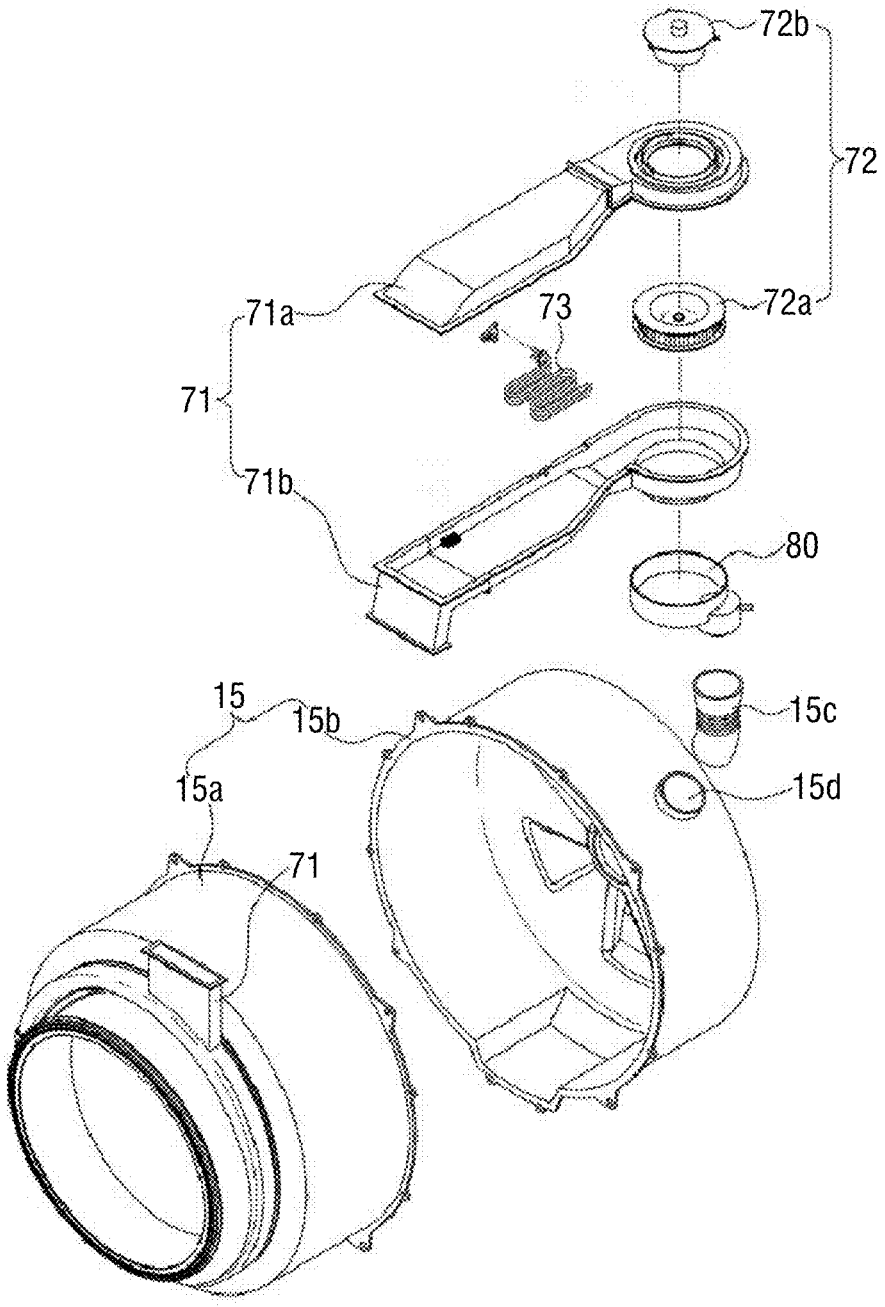
FIG. 3 is an exploded perspective view of a drying unit according to an embodiment of the disclosure.

FIG. 3 is an exploded perspective view of the drying unit according to an embodiment of the disclosure.

As illustrated in FIG. 3, the drying unit 70 may include a drying duct 71, a suction unit 72, and a heater unit 73.

In the drying duct 71, the air introduced from the tub 15 and the drum 20 is heated and then transferred to the tub 15. Specifically, the drying duct 71 includes an upper duct portion 71*a* and a lower duct portion 71*b*, and one end side of the upper duct portion 71*a* and the lower duct portion 71*b* coupled with each other is connected to the front tub member 15*a* and the other end side is connected to the back tub member 15*b*. As a result, the drying duct 71 may transfer the air introduced from the back tub member 15*b* to the front tub member 15*a* through a passage formed by coupling the upper duct portion 71*a* and the lower duct portion 71*b* with each other.

The suction unit 72 sucks the air in the tub 15 and the drum 20 and transfers the sucked air to the drying duct 71. Such a suction unit 72 includes a suction fan 72*a* and a suction motor 72*b* for rotating the suction fan 72*a*. The suction fan 72*a* may be positioned at a lower opening (not illustrated) formed in the lower duct portion 71*b* of the drying duct 71, and the suction motor 72*b* may be positioned at an upper opening (not illustrated) formed in the upper duct portion 71*a* of the drying duct 71.

Further, the heater unit 73 heats the air in the tub and the drum 20, the air being sucked through the suction unit 72. Such a heater unit 73 may be formed in the passage formed by coupling the upper duct portion 71*a* and the lower duct portion 71*b* with each other. Accordingly, the heater unit 73 may beat the air in the tub and the drum 20, the air being introduced into the drying duct 71 through the suction unit 72, and the drying duct 71 may transfer the air heated by the heater unit 73 to the front tub member 15*a*.

In addition, a temperature sensor (not illustrated) may be provided in the passage formed by coupling the upper duct portion 71*a* and the lower duct portion 71*b* with each other. Specifically, the temperature sensor (not illustrated) is positioned at a side of the upper duct portion 71*a* and the lower duct portion 71*b* coupled with each other, the side being connected to the front tub member 15*a*. By doing so, the temperature sensor (not illustrated) may measure a temperature of the air heated by the heater unit 73.

As such, in the drying duct 71, once the air in the tub 15 and the drum 20 is introduced into the drying duct 71, the air being sucked by the suction unit 72, the introduced air may be heated by the heater unit 73 and the heated air may be transferred to the inside of the tub 15 and the drum 20. As a result, a temperature of the air in the tub 15 and the drum 20 may be maintained at an adequate level during the drying process.

Figure 4:
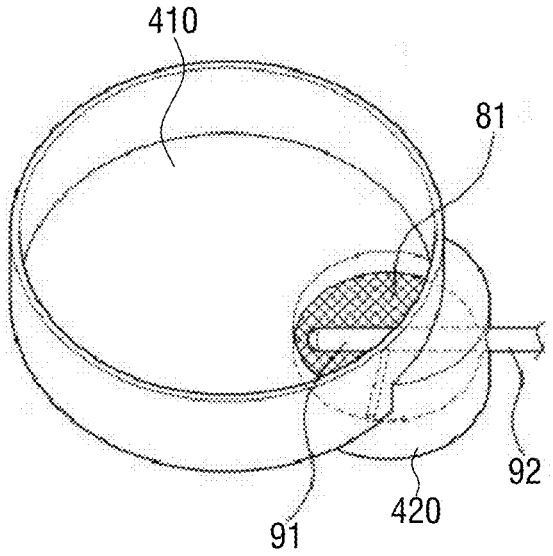
FIG. 4 is a perspective view of a filter unit according to an embodiment of the disclosure.

FIG. 4 is a perspective view of the filter unit according to an embodiment of the disclosure.

As illustrated in FIG. 4, the filter unit 80 filtering the lint generated from the laundry received in the drum 20 during the drying process may have a shape of a cylinder with an opened upper portion and a partially closed lower portion. A first region 410 of the filter unit 80, of which an upper portion is opened, may be a region into which the suction fan 72*a* of the suction unit 72 is inserted, and a second region 420 of the filter unit 80, of which a lower portion is partially opened, may be a region into which the guide tube 15*c* for guiding the air in the tub 15 and the drum 20 toward the drying unit 70 is inserted. A lint filter 81 for filtering the foreign matter including the lint generated from the laundry received in the drum 20 is formed in such a second region 420.

Therefore, the cleaning unit 90 may be provided in the region in which the lint filter 81 is formed. Specifically, the cleaning unit 90 may include a spray nozzle 91 spraying cleaning water to the region in which the lint filter 81 is formed, and a cleaning water supply tube 92 supplying the cleaning water to the spray nozzle 91. The cleaning unit 90 periodically sprays, to the region in which the lint filter 81 is formed, the cleaning water supplied through the cleaning water supply tube 92, through the spray nozzle 91. As a result, the foreign matter including the lint, stuck onto the lint filter 81 may be removed by the cleaning water sprayed through the spray nozzle 91.

Hereinabove, the respective components of the washing machine, which perform the washing and drying of the laundry received in the drum 20 according to the disclosure, have been described roughly. Hereinafter, respective components of the washing machine, which perform the drying process for the laundry according to the disclosure, will be described in detail.

Figure 5:
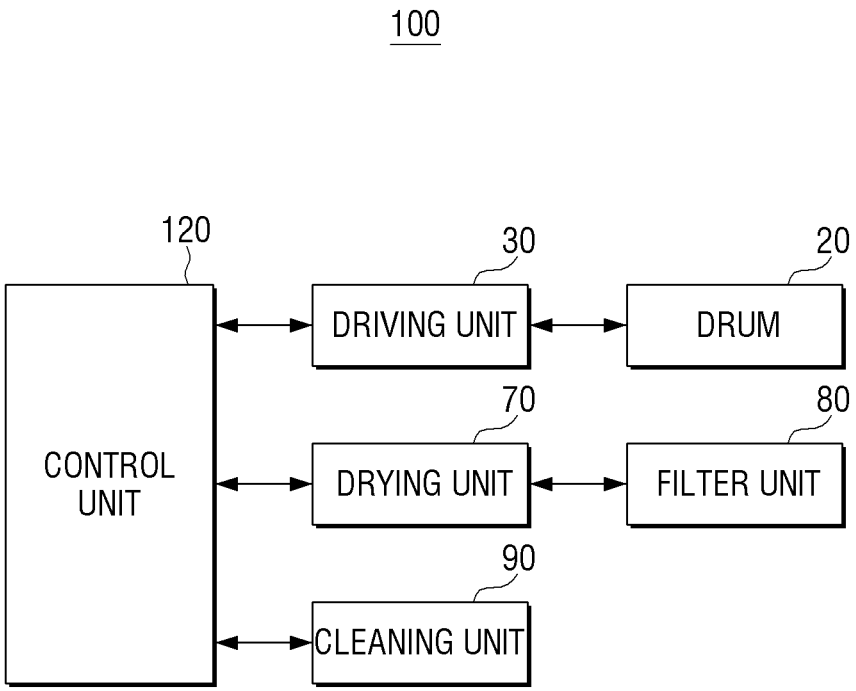
FIG. 5 is a block diagram of the washing machine which performs a drying process according to an embodiment of the disclosure.

FIG. 5 is a block diagram of the washing machine which performs the drying process according to an embodiment of the disclosure.

As illustrated in FIG. 5, the washing machine 100 includes the drum 20, the driving unit 30, the drying unit 70, the filter unit 80, the cleaning unit 90, and the control unit 120.

As described above, the drum 20 receives laundry and the driving unit 30 rotates the drum 20 in which the laundry is received. Specifically, the driving unit 30 may rotate the drum 20 in which the laundry is received by driving the driving motor. Further, the driving unit 30 may drive the water supply unit 40 to supply cleaning water to the inside of the tub 15, or may drive the water drainage unit 50 to drain wash water received in the tub 15 to the outside of the washing machine 100.

The drying unit 70 adjusts a temperature of air in the drum 20 to dry the laundry received in the drum 20, and the filter unit 80 filters foreign matter including the lint generated from the laundry received in the drum 20.

Here, the lint may be fibers generated due to friction between the laundry caused by the rotation of the drum 20 in a process of drying the laundry received in the drum 20 by rotating the drum 20 during a drying process.

Further, the cleaning unit 90 sprays the cleaning water to the filter unit 80 to clean the filter unit 80. As a result, the lint filtered by the filter unit 80 is removed by the cleaning water sprayed by the cleaning unit 90.

The control unit 120 controls overall operation with respect to the respective components constituting the washing machine 100 so that the laundry received in the drum 20 may be washed and dried. Specifically, the control unit 120 controls the drying unit 70 to dry the laundry received in the drum 20 during the drying process. Accordingly, the drying unit 70 sucks the air in the tub 15 and the drum 20, heats the sucked air to an adequate temperature at which the laundry received in the drum 20 may be dried, and transfers the heated air to the inside of the tub 15 and the drum 20.

According to an embodiment, the control unit 120 measures an internal temperature of the tub 15 based on a value sensed by the temperature sensor 16 provided in the tub 15. Thereafter, the control unit 120 may control the drying unit 70 to raise the internal temperature of the tub 15 based on a difference between the measured temperature and a predetermined threshold temperature, which is obtained by comparing the measured temperature and the predetermined threshold temperature with each other. According to such a control command, the drying unit 70 heats the air sucked from the tub 15 and the drum 20 to the predetermined threshold temperature, and transfers the heated air to the inside of the tub 15 and the drum 20.

Further, the control unit 120 controls the cleaning unit 90 to periodically clean the filter unit 80 during the rotation of the drum 20, in the drying process. Accordingly, the cleaning unit 90 may periodically spray the cleaning water to the filter unit 80 to remove, from the filter unit 80, the lint filtered by the filter unit 80 during the drying process.

According to an embodiment, the control unit 120 may control the cleaning unit 90 to periodically clean the filter unit 80 from a point in time at which a predetermined first threshold time elapses after the drying process starts.

For example, the predetermined first threshold time may be 15 minutes. In this case, once the drying process starts, the control unit 120 may perform counting from a point in time at which the drying process starts to control the cleaning unit 90 to periodically clean the filter unit 80 from a point in time at which 15 minutes elapse after the drying process starts.

Accordingly, the cleaning unit 90 may periodically spray the cleaning water to the filter unit 80 so that the lint filtered by the filter unit 80 may be removed from a point in time at which 15 minutes elapse after the drying process starts.

According to another embodiment, the control unit 120 may control the cleaning unit 90 to periodically clean the filter unit 80 until a point in time at which a predetermined second threshold time elapses after the drying process starts.

For example, a total drying process time may be 60 minutes and the predetermined second threshold time may be 50 minutes. In this case, once the drying process starts, the control unit 120 may perform counting from a point in time at which the drying process starts to control the cleaning unit 90 to periodically clean the filter unit 80 until a point in time at which 50 minutes elapse after the drying process starts.

That is, once the drying process starts, the control unit 120 may control the cleaning unit 90 to periodically clean the filter unit 80 until 10 minutes before the drying process is terminated.

Accordingly, the cleaning unit 90 may periodically spray the cleaning water to the filter unit 80 so that the lint filtered by the filter unit 80 may be removed until 10 minutes before the drying process is terminated.

According to another embodiment, the control unit 120 may control the cleaning unit 90 to periodically clean the filter unit 80 from a point in time at which the predetermined first threshold time elapses until a point in time at which the predetermined second threshold time elapses, after the drying process starts.

For example, the total drying process time may be 60 minutes, the predetermined first threshold time may be 15 minutes, and the predetermined second threshold time may be 50 minutes.

In this case, once the drying process starts, the control unit 120 performs counting from a point in time at which the drying process starts to control the cleaning unit 90 to periodically clean the filter unit 80 from a point in time at which 15 minutes elapse after the drying process starts. At this time, the control unit 120 may count time after the drying process starts to control the cleaning unit 90 to periodically clean the filter unit 80 until the drying process time reaches 50 minutes.

That is, after the drying process starts, the control unit 120 may control the cleaning unit 90 to periodically clean the filter unit 80 from a point in time at which 15 minutes elapse until 10 minutes before the drying process is terminated.

Accordingly, the cleaning unit 90 may periodically spray the cleaning water to the filter unit 80 to remove the lint filtered by the filter unit 80 from a point in time at which 15 minutes elapse after the drying process starts until 10 minutes before the drying process is terminated.

Meanwhile, the first threshold time described above may be an interval of time within a first interval and the second threshold time may be an interval of time within a second interval.

According to an embodiment, a drying process interval may be divided into a heating interval and a cooling interval. Here, the heating interval is an interval during which the laundry received in the drum 20 is dried by the rotation of the drum 20, in which the laundry is received, and the air heated to an adequate temperature and introduced into the drum 20, once the drying process starts. Further, the cooling interval following completion of the drying process in the heating interval is an interval during which the laundry received in the drum 20 is dried by the rotation of the drum 20.

Meanwhile, the heating interval may be divided into a first heating interval and a second heating interval.

The first heating interval is an interval during which the drum 20 in which the laundry is received rotates at a first rotation speed, and the second heating interval is an interval during which the drum 20 in which the laundry is received rotates at a speed higher than the first rotation speed.

In this case, according to an embodiment, the first threshold time may be an interval of time within the first heating interval during which the drum 20 in which the laundry is received rotates at the first rotation speed or may be an interval of time after which the first heating interval is to be ended. Further, the second threshold time may be an interval of time within the second heating interval during which the drum 20 in which the laundry is received rotates at the second rotation speed or may be an interval of time after which the second heating interval is to be ended.

According to another embodiment, the first threshold time may be an interval of time within the first heating interval during which the drum 20 in which the laundry is received rotates at the first rotation speed or may be an interval of time after which the first heating interval is to be ended. Further, the second threshold time may be an interval of time within the cooling interval following the completion of the drying process in the heating interval or may be an interval of time after which the cooling interval is to be ended.

According to another embodiment, the first threshold time may be an interval of time within the second heating interval during which the drum 20 in which the laundry is received rotates at the second rotation speed or may be an interval of time after which the second heating interval is to be ended. Further, the second threshold time may be an interval of time within the cooling interval following the completion of the drying process in the heating interval or may be an interval of time after which the cooling interval is to be ended.

Meanwhile, the control unit 120 may control the cleaning unit 90 to clean the filter unit 80 according to the following embodiments during a cleaning interval.

According to an embodiment, the control unit 120 may control the cleaning unit 90 to clean the filter unit 80 every predetermined time unit during the cleaning interval.

For example, a total cleaning interval may be 30 minutes and the predetermined time unit may be set to 10 minutes. In this case, the control unit 120 may control the cleaning unit 90 to clean the filter unit 80 every 10 minutes during the cleaning interval. Accordingly, the cleaning unit 90 may clean the filter unit 80 by spraying the cleaning water to the filter unit 80 every 10 minutes during the cleaning interval.

According to another embodiment, the control unit 120 may control the cleaning unit 90 to clean the filter unit 80 every time unit set to vary depending on the respective intervals in the drying process.

Specifically, the control unit 120 may control the cleaning unit 90 to clean the filter unit 80 every predetermined first time unit during the first heating interval in the heating interval, during which not much lint is generated. Meanwhile, the control unit 120 may control the cleaning unit 90 to clean the filter unit 80 every second time unit shorter than the predetermined first time unit during the second heating interval and the cooling interval during which a large amount of lint is generated.

Accordingly, the cleaning unit 90 may spray the cleaning water to the filter unit 80 every first time unit during the first heating interval in the heating interval to remove the lint filtered by the filter unit 80, and spray the cleaning water to the filter unit 80 every second time unit shorter than the first time during the second heating interval and the cooling interval to remove the lint filtered by the filter unit 80.

According to another embodiment, the control unit 120 may control the cleaning unit 90 to clean the filter unit 80 every time unit set to vary depending on a type of the laundry received in the drum 20.

For example, a storage unit 140 to be described later may store cleaning cycle information for cleaning of the filter unit 80, for each type of laundry. Specifically, in a case where the laundry is first type laundry in which materials such as cotton, knits, and synthetic fibers are mixed, a cleaning cycle may be set to a time unit corresponding to a normal mode. Further, in a case where the laundry is second type laundry such as cotton or synthetic fibers, from which not much lint is generated, the cleaning cycle may be set to a time unit longer than the time unit corresponding to the normal mode. Further, in a case where the laundry is third type laundry such as knits, from which a large amount of lint is generated, the cleaning cycle may be set to a time unit shorter than the time unit corresponding to the normal mode.

Accordingly, once one of such a plurality of types of laundry is selected, the control unit 120 may control the cleaning unit 90 to clean the filter unit 80 every time unit corresponding to the selected type.

Meanwhile, the control unit 120 controls the driving unit 30 to rotate at the first rotation speed during the first interval in the entire interval for the drying process and rotate at the second rotation speed higher than the first rotation speed during the second interval in the entire interval according to a dried state of the laundry.

As described above, the first interval during which the drum 20 rotates at the first rotation speed may be the first heating interval in the heating interval, and the second interval during which the drum 20 rotates at the second rotation speed may be the second heating interval.

However, the disclosure is not limited thereto, and the first interval during which the drum 20 rotates at the first rotation speed may be the first heating interval in the heating interval, and the second interval during which the drum 20 rotates at the second rotation speed may include the second heating interval and the cooling interval.

As described above, the heating interval may be an interval during which the laundry is dried by the rotation of the drum 20 and introduction of the heated air into the drum 20, and the cooling interval may be an interval during which the laundry is dried by the rotation of the drum 20.

According to an embodiment, the control unit 120 may control the driving unit 30 to rotate at 45 rpm during the first interval, and rotate at 60 rpm during the second interval. According to such a control command, the driving unit 30 may rotate the drum 20 at 45 rpm during the first interval, and rotate the drum 20 at 60 rpm during the second interval.

That is, the control unit 120 may control the driving unit 30 to rotate at 45 rpm during the first heating interval, and rotate at 60 rpm during the second heating interval and the cooling interval.

Meanwhile, the control unit 120 may control the driving unit 30 to rotate while changing the rotation speed within the heating interval according to the following embodiments.

According to an embodiment, once the drying process starts, the control unit 120 may perform counting from a point in time at which the drying process starts to control the driving unit 30 to rotate while changing its rotation speed to the first rotation speed or the second rotation speed higher than the first rotation speed depending on whether or not a predetermined threshold time elapses.

For example, the total drying process interval may be set to 60 minutes, and in the entire process interval, an operation time in the heating interval may be set to 45 minutes and an operation time in the cooling interval may be set to 15 minutes. Further, an operation time in the first heating interval may be set to 30 minutes in the entire heating interval, and an operation time in the second heating interval may be set to 15 minutes.

In this case, once the drying process starts, the control unit 120 controls the driving unit 30 to perform a drying operation corresponding to the first heating interval. That is, the control unit 120 controls the driving unit 30 to rotate at the first rotation speed during the first heating interval. Accordingly, the driving unit 30 may rotate the drum 20 at 45 rpm, which is the first rotation speed, during the first heating interval. Meanwhile, the control unit 120 performs counting from a point in time at which the drying process starts, and in a case where it is determined that 30 minutes set as the operation time in the first heating interval elapse, the control unit 120 controls the driving unit 30 to perform a drying operation corresponding to the second heating interval. That is, the control unit 120 controls the driving unit 30 to rotate at the second rotation speed higher than the first rotation speed during the second heating interval. Accordingly, the driving unit 30 may rotate the drum 20 at 60 rpm, which is the second rotation speed, during the second heating interval.

According to another embodiment, once the drying process starts, the control unit 120 may measure a weight of the laundry received in the drum 20 to control the driving unit 30 to rotate while changing its rotation speed to the first rotation speed or the second rotation speed higher than the first rotation speed depending on a degree of change in the measured weight.

Specifically, the control unit 120 calculates a change amount based on a difference between an initial weight value, which is a value measured first, and a current weight value, which is a value currently measured, and compares the calculated change amount and a predetermined threshold value, and in a case where the calculated change amount is less than the predetermined threshold value, the control unit 120 controls the driving unit 30 to perform the drying operation by performing a change from the first heating interval to the second heating interval.

Meanwhile, the control unit 120 controls the drying unit 80 such that the air in the drum 20 is maintained at the predetermined threshold temperature during the entire heating interval including the first and second heating intervals. Accordingly, the drying unit 80 heats the air introduced into the drying unit 80 to the predetermined threshold temperature during the heating interval and transfers the heated air to the inside of the drum 20.

Meanwhile, in a case where it is determined that the drying operation in the heating interval is completed, based on the operation time in the entire heating interval including the first and second heating intervals, the control unit 120 controls the driving unit 30 and the drying unit 80 to perform a drying operation corresponding to the cooling interval. That is, the control unit 120 controls the driving unit 30 to rotate at the second rotation speed during the cooling interval and turns off a heating operation of the drying unit 80, in which the air is heated to the predetermined temperature.

Accordingly, the driving unit 30 rotates the drum 20 at 60 rpm, which is the second rotation speed, during the cooling interval, and the drying unit 80 stops the heating operation of heating the air to the predetermined temperature.

As described above, the control unit 120 controls the driving unit 30 such that the drum 20 in which the laundry is received rotates at the first rotation speed during the first interval in the entire drying process interval, and rotates at the second rotation speed higher than the first rotation speed during the second interval. As a result, the amount of lint generated during the drying process may be reduced.

Further, the control unit 120 controls the cleaning unit 90 to periodically clean the filter unit 80, which filters the lint, in the drying process. As such, the cleaning unit 90 periodically removes the lint filtered by the filter unit 80, such that the air in the tub 15 and the drum 20 may be circulated smoothly through the drying unit 70.

Meanwhile, the control unit 120 controls the driving unit 30 such that the drum 20 in which the laundry is received rotates at the third rotation speed, which is higher than the second rotation speed in the second interval, during the cleaning interval during which the filter unit 80 is cleaned. According to an embodiment, the third rotation speed may be 80 rpm.

Meanwhile, the control unit 120 controls the drying unit 70 such that at least one of the suction unit 72 or the heater unit 73 is turned off during the cleaning interval during which the filter unit 80 is cleaned, the suction unit 72 sucking the air in the drum 20 and the heater unit 73 heating the sucked air.

Specifically, once the cleaning cycle for the filter unit 80 starts, the control unit 120 performs a control to stop the operation related to the drying process during the cleaning interval. Specifically, once the cleaning cycle for the filter unit 80 starts, the control unit 120 controls the drying unit 70 such that at least one of the suction unit 72 or the heater unit 73 is turned off, the suction unit 72 sucking the air in the drum 20 and the heater unit 73 heating the sucked air. Then, the control unit 120 controls the driving unit 30 such that the drum 20, in which the laundry is received, rotates at a rotation speed, which is higher than the rotation speed in the drying process. Accordingly, the driving unit 30 rotates the drum 20 at 80 rpm, which is higher than the rotation speed in the drying process. As such, as the drum 20 rotates at the rotation speed of 80 rpm, it is possible to prevent the cleaning water sprayed to the filter unit 80 from permeating into the laundry received in the drum 20.

When the drum 20 rotates at the rotation speed of 80 rpm, the control unit 120 controls the cleaning unit 90 to clean the filter unit 80. Accordingly, the cleaning unit 90 sprays, to the filter unit 80, the cleaning water through the spray nozzle 91 for a predetermined threshold time (about 1 second) to thereby remove the lint filtered by the filter unit 80.

Once the cleaning of the filter unit 80 is completed through such a series of processes, the control unit 120 performs a control to start the operation related to the drying process. That is, the control unit 120 controls the driving unit 30 such that the drum 20, in which the laundry is received, rotates at a rotation speed corresponding to the rotation speed in the drying process. As in the above-described example, the driving unit 30 may rotate the drum 20 at 45 rpm, which is the first rotation speed, during the first interval in the drying process interval, and rotate the drum 20 at 60 rpm, which is the second rotation speed, during the second interval in the drying process interval.

Further, the control unit 120 controls the drying unit 70 to adjust the temperature of the air in the drum 20. Accordingly, the drying unit 70 may suck the air in the tub 15 and the drum 20 through the suction unit 72, heat the sucked air using the heater unit 73, and transfer the heated air to the tub 15 and the drum 20.

Figure 6:
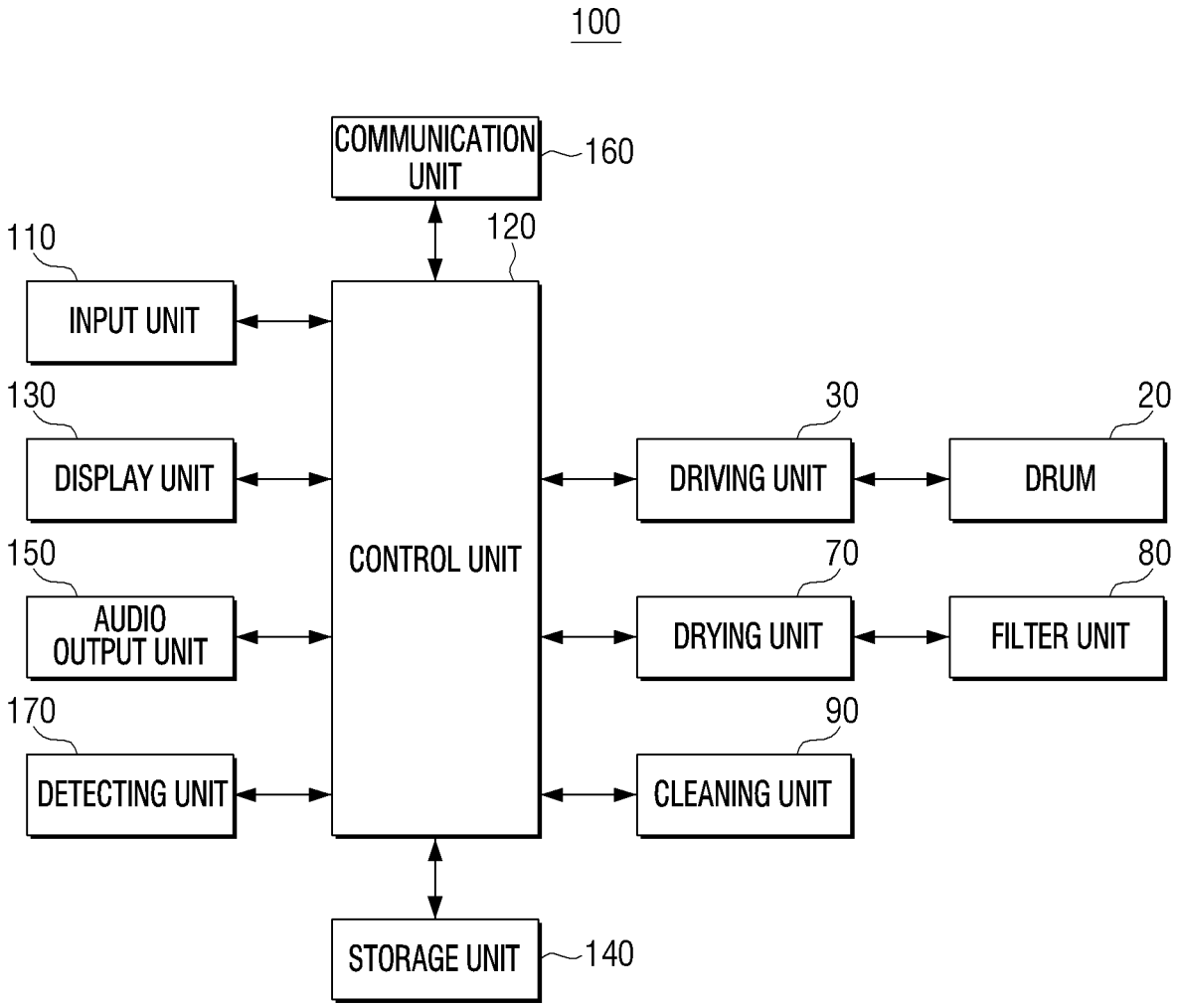
FIG. 6 is a detailed block diagram of the washing machine according to an embodiment of the disclosure.

FIG. 6 is a detailed block diagram of the washing machine according to an embodiment of the disclosure.

The washing machine 100 may further include the input unit 110, the display unit 130, the storage unit 140, an audio output unit 150, a communication unit 160, and a detecting unit 170, in addition to the above-described components.

The input unit 110 and the display unit 130 have been described above in detail, and thus a detailed description thereof will be omitted below.

The storage unit 140 may store control information and an operating program for performing the operation related to the washing process and the drying process. Here, the control information may include driving information for rotating the drum 20, information for cleaning the filter unit 80, and the like as described above. Further, the operating program may be a program read from the storage unit 140 and complied to operate the respective components of the washing machine 100 when the washing machine 100 is turned on. Such a storage unit 140 may be implemented by at least one of a read only memory (ROM), a random access memory (RAM), a removable memory card (for example, a secure digital (SD) card or a memory stick) in an electronic device 100, a non-volatile memory, a volatile memory, a hard disk drive (HDD), or a solid state drive (SDD).

The audio output unit 150 outputs a state of the operation related to the washing process and the drying process of the washing machine 100 in a form of audible sound through a speaker (not illustrated).

The communication unit 160 performs wireless communication with at least one user terminal device (not illustrated). According to an embodiment, the communication unit 160 may perform data communication with the user terminal device (not illustrated) through a short-range communication module such as a Bluetooth module, a near field communication (NFC) module, a wireless fidelity (WiFi) module, or a Zigbee module to transmit, to the user terminal device (not illustrated), information regarding a state related to the washing process and the drying process, or receive, from the user terminal device (not illustrated), a control command related to the washing and drying.

In addition, the communication unit 160 may be connected to an external network according to a wireless communication protocol such as IEEE, to perform communication, like a wireless local area network (LAN) module.

The detecting unit 170 detects the state of the operation related to the washing process and the drying process of the washing machine 100. According to an embodiment, the detecting unit 170 may include a temperature sensor which detects a temperature of the air in the tub 15 and the drum 20 or detects a temperature of the air heated by the drying unit 70, a sensor which measures a weight of the drum 20 in which the laundry is received, and the like.

Figure 7:
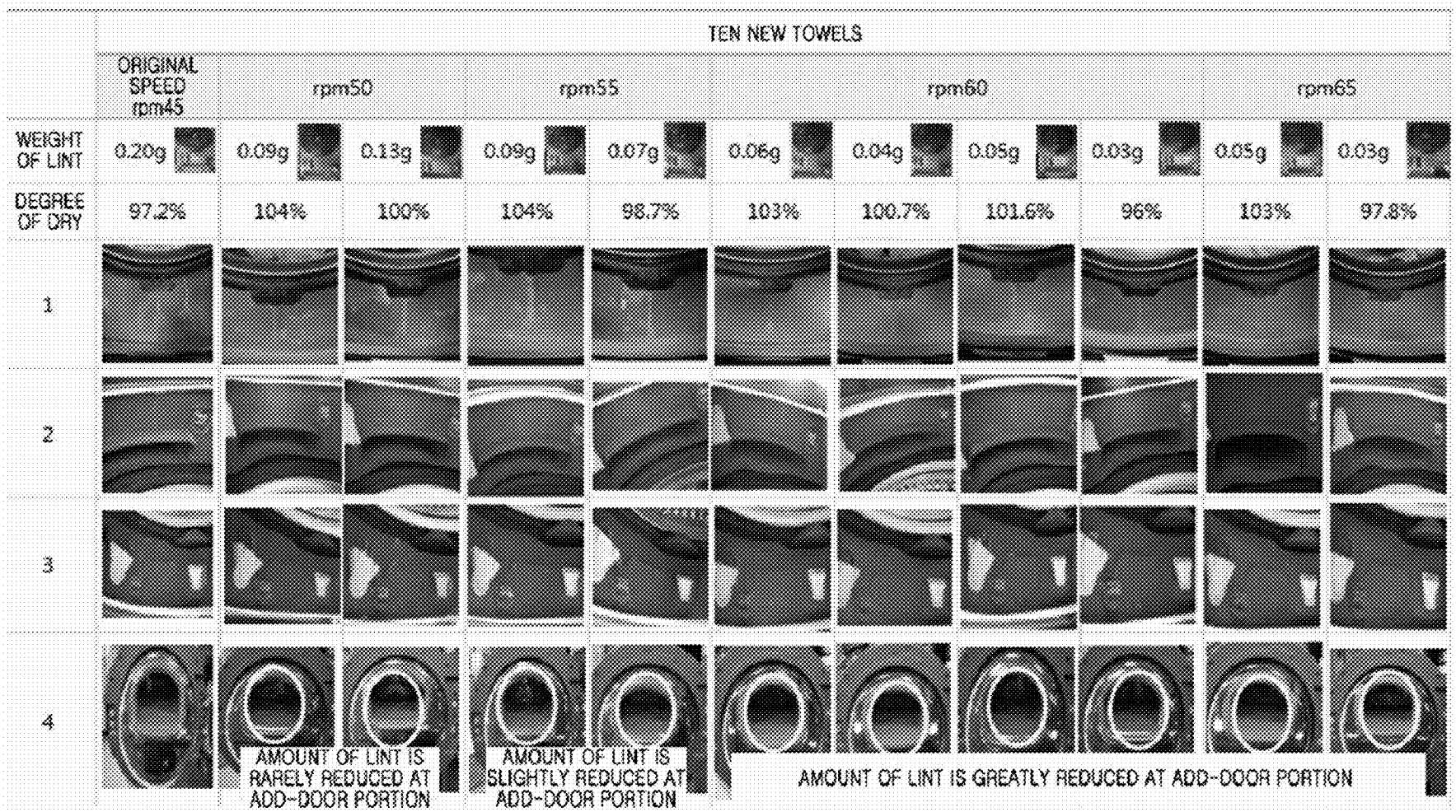
FIG. 7 is an illustrative diagram showing a result of an experiment on amount of lint generated from laundry depending on a rotation speed of a drum in the washing machine according to an embodiment of the disclosure.
Figure 8:
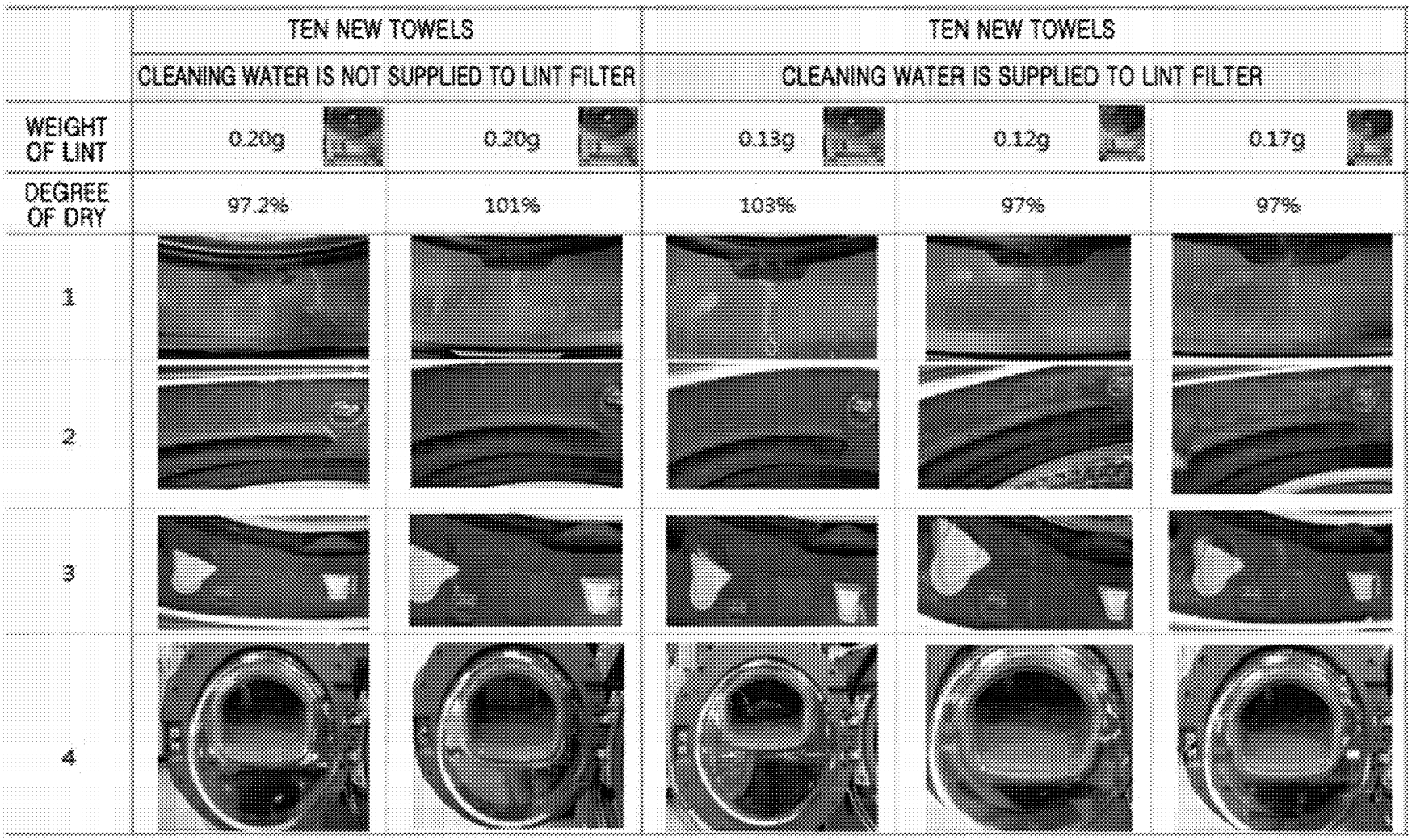
FIG. 8 is an illustrative diagram showing a result of an experiment on amount of lint generated from laundry depending on whether or not the filter unit is cleaned in the washing machine according to an embodiment of the disclosure.

FIG. 7 is an illustrative diagram showing a result of an experiment on amount of lint generated from laundry depending on a rotation speed of the drum in the washing machine according to an embodiment of the disclosure, and FIG. 8 is an illustrative diagram showing a result of an experiment on amount of lint generated from laundry depending on whether or not the filter unit is cleaned in the washing machine according to an embodiment of the disclosure.

As shown in FIG. 7, the amount of lint generated from the laundry varies depending on the rotation speed of the drum 20. Specifically, in a case where the drum 20 rotates at a rotation speed of 45 rpm and a degree of dry of the laundry received in the drum 20 is about 97.2%, about 0.20 g of lint may be distributed in the drum 20. Further, in a case where the drum 20 rotates at a rotation speed of 60 rpm and a degree of dry of the same laundry received in the drum 20 is about 96%, about 0.03 g of lint may be distributed in the drum 20. Further, in a case where the drum 20 rotates at a rotation speed of 65 rpm and a degree of dry of the same laundry received in the drum 20 is about 97.8%, about 0.03 g of lint may be distributed in the drum 20.

That is, it may be appreciated that the amount of lint generated in a case where the drum 20 rotates at 60 rpm or 65 rpm is reduced by about 80%, compared to the amount of lint generated in a case where the drum 20 rotates at 45 rpm under condition of the same degree of dry of the laundry.

Further, in a case where the drum 20 rotates at 60 rpm or 65 rpm, the amount of lint distributed in a fourth region 4, which is a door region, among first to fourth regions 1 to 4 in the drum 20 is reduced, compared to the amount of distributed lint in a case where the drum 20 rotates at 45 rpm or 55 rpm.

As may be seen from this experiment, in a case where the drum 20 rotates at 60 rpm or 65 rpm in this experiment, the amount of lint generated from the laundry received in the drum 20 and the amount of lint distributed in a specific region in the drum 20 may be reduced.

Meanwhile, as shown in FIG. 8, the amount of lint generated from the laundry received in the drum 20 may be reduced in a case where the filter unit 80 filtering the lint is cleaned.

Specifically, it may be appreciated that about 0.20 g of lint generated from the laundry is distributed in the drum 20 in a case of not cleaning the filter unit 80, and about 0.13 g to 0.17 g of lint generated from the same laundry is distributed in the drum in a case of periodically cleaning the filter unit 80.

As may be seen from this experiment, the amount of lint generated from the laundry received in the drum 20 may be reduced in a case of periodically cleaning the filter unit 80 filtering the lint.

Figure 9:
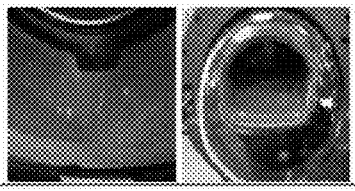
FIG. 9 is an illustrative diagram showing a result of an experiment on amount of lint generated from laundry depending on whether or not the rotation speed of the drum is controlled and whether or not the filter unit is cleaned in the washing machine according to an embodiment of the disclosure.
Figure 9:
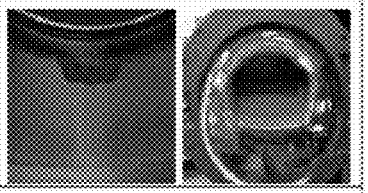
Figure 9:
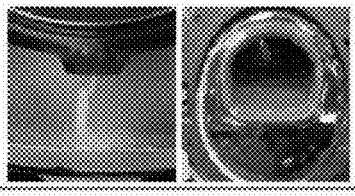
Figure 9:
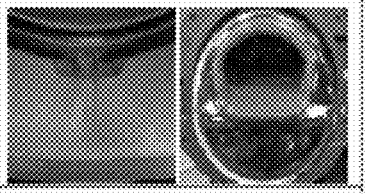
Figure 9:
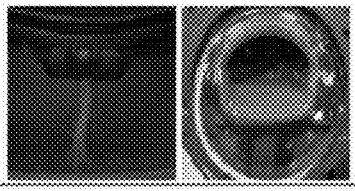
Figure 9:
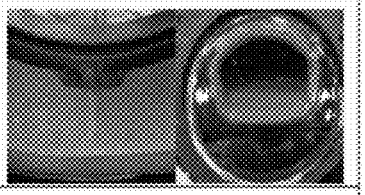
Figure 9:
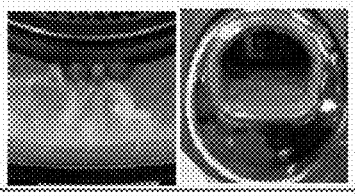
Figure 9:
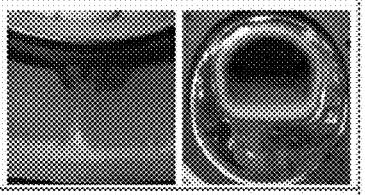
Figure 9:
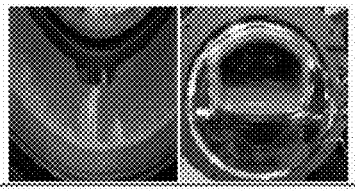
Figure 9:
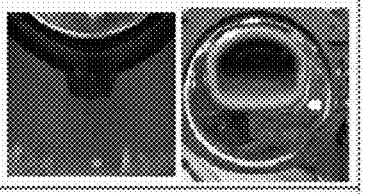
Figure 9:
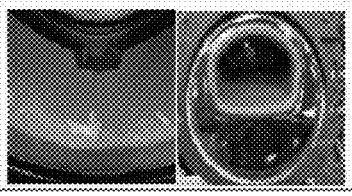
Figure 9:
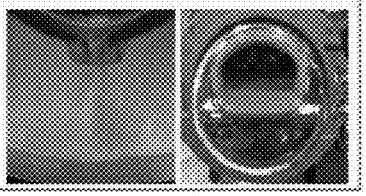

FIG. 9 is an illustrative diagram showing a result of an experiment on amount of lint generated from laundry depending on whether or not the rotation speed of the drum is controlled and whether or not the filter unit is cleaned in the washing machine according to an embodiment of the disclosure.

As shown in FIG. 9, it may be appreciated that in a case where the rotation speeds of 45 rpm and 60 rpm of the drum 20 are divisionally applied and the filter unit 80 filtering the lint is periodically cleaned, the amount of lint is remarkably reduced in the washing machine 100 according to the disclosure, compared to the washing machine according to the related art in which the rotation speed of the drum 20 is changed in stages to dry the laundry.

Specifically, it may be appreciated that in a case where the laundry is dried by the washing machine 100 according to the disclosure, the amount of lint generated from 1 kg of laundry is reduced by about 52.4%, compared to the amount of lint generated from the laundry dried by the washing machine according to the related art.

Specifically, it may be appreciated that in a case of drying 5 kg of laundry, the amount of lint generated from the laundry dried by the washing machine 100 according to the disclosure is most reduced (about 62.5%), compared to the amount of lint generated from the laundry dried by the washing machine 100 according to the related art.

Hereinafter, a method of performing drying and cleaning-out of lint in the washing machine according to an embodiment will be described in detail.

Figure 10:
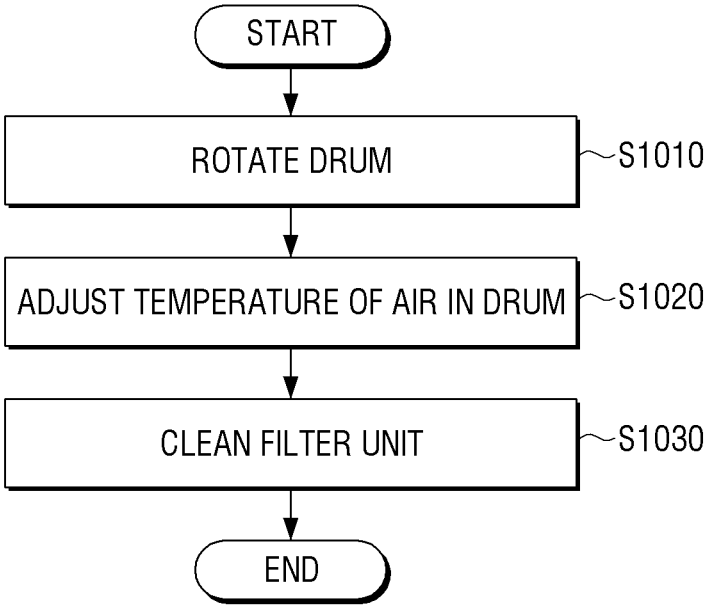
FIG. 10 is a flowchart illustrating a method of performing drying and cleaning-out of lint in the washing machine according to an embodiment of the disclosure.

FIG. 10 is a flowchart illustrating a method of performing drying and cleaning-out of lint in the washing machine according to an embodiment of the disclosure.

As illustrated in FIG. 10, once a drying process starts, the washing machine 100 rotates a drum in which laundry is received (S1010). Once the rotation of the drum starts, the washing machine 100 adjusts a temperature of air in the drum to dry the laundry received in the drum (S1020). Specifically, the washing machine 100 may adjust the temperature of the air in the drum to an adequate temperature by heating the air sucked from the inside of the drum through a suction unit by using a heater unit.

Then, the washing machine 100 periodically cleans a filter unit for filtering lint generated from the laundry, during the rotation of the drum (S1030).

Specifically, once the drying process starts, the washing machine 100 rotates the drum at a first rotation speed during a first interval in the entire interval for the drying process and rotates the drum at a second rotation speed higher than the first rotation speed during a second interval according to a dried state of the laundry.

Here, the first rotation speed may be 45 rpm and the second rotation speed may be 60 rpm.

Meanwhile, the drying process interval may be divided into a heating interval and a cooling interval. Further, the cooling interval following completion of the drying process in the heating interval is an interval during which the laundry received in the drum is dried by the rotation of the drum.

Meanwhile, the heating interval is an interval during which the laundry received in the drum is dried by the rotation of the drum, in which the laundry is received, and the air heated to an adequate temperature and introduced into the drum, once the drying process starts.

Such a heating interval may be divided into a first heating interval and a second heating interval, the first heating interval being an interval during which the drum, in which the laundry is received, rotates at the first rotation speed, and the second heating interval being an interval during which the drum, in which the laundry is received, rotates at a speed higher than the first rotation speed.

In this case, the first interval described above may be the first heating interval and the second interval described above may be the second heating interval. However, the disclosure is not limited thereto, and the first interval described above may be the first heating interval and the second interval described above may be the second heating interval and the cooling interval.

Meanwhile, the washing machine 100 may periodically clean the filter unit according the following embodiments.

According to an embodiment, the washing machine 100 may periodically clean the filter unit from a point in time at which a predetermined first threshold time elapses after the drying process starts.

According to another embodiment, the washing machine 100 may periodically clean the filter unit until a point in time at which a predetermined second threshold time elapses after the drying process starts.

According to another embodiment, the washing machine 100 may periodically clean the filter unit from a point in time at which the predetermined first threshold time elapses until a point in time at which the predetermined second threshold time elapses, after the drying process starts.

According to the embodiment described above, the washing machine 100 cleaning the filter unit rotates the drum at a third rotation speed higher than the second rotation speed described above during a cleaning interval during which the filter unit is cleaned. Here, the third rotation speed may be 80 rpm. As the drum rotates at 80 rpm during the cleaning interval, it is possible to prevent part of cleaning water sprayed to the filter unit from being introduced into the drum and permeating into the laundry received in the drum.

Meanwhile, the first threshold time described above may be an interval of time within a first interval and the second threshold time may be an interval of time within a second interval.

In this case, according to an embodiment, the first threshold time may be an interval of time within the first heating interval during which the drum in which the laundry is received rotates at the first rotation speed or may be an interval of time after which the first heating interval is to be ended. Further, the second threshold time may be an interval of time within the second heating interval during which the drum in which the laundry is received rotates at the second rotation speed or may be an interval of time after which the second heating interval is to be ended.

According to another embodiment, the first threshold time may be an interval of time within the first heating interval during which the drum in which the laundry is received rotates at the first rotation speed or may be an interval of time after which the first heating interval is to be ended. Further, the second threshold time may be an interval of time within the cooling interval following the completion of the drying process in the heating interval or may be an interval of time after which the cooling interval is to be ended.

According to another embodiment, the first threshold time may be an interval of time within the second heating interval during which the drum in which the laundry is received rotates at the second rotation speed or may be an interval of time after which the second heating interval is to be ended. Further, the second threshold time may be an interval of time within the cooling interval following the completion of the drying process in the heating interval or may be an interval of time after which the cooling interval is to be ended.

Hereinafter, a method of performing a drying process in the washing machine 100 will be described in detail.

Figure 11:
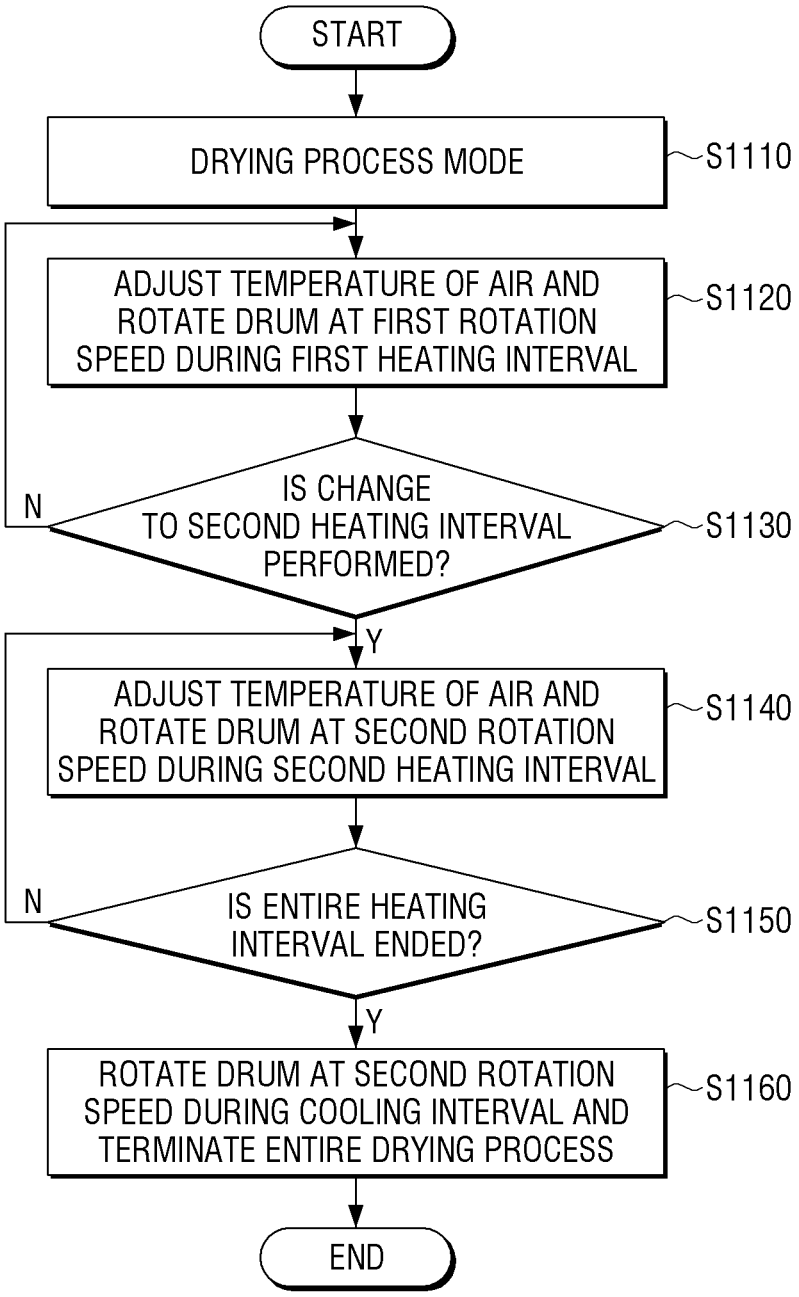
FIG. 11 is a flowchart illustrating a method of performing a drying process in the washing machine according to an embodiment of the disclosure.

FIG. 11 is a flowchart illustrating a method of performing a drying process in the washing machine according to an embodiment of the disclosure.

As illustrated in FIG. 11, once washing of the laundry received in the drum is completed, the washing machine 100 enters a drying process mode for the laundry (S1110). After entering the drying process mode, the washing machine 100 rotates the drum at the first rotation speed during the first heating interval which is the first interval in the entire heating interval (S1120). Here, the first rotation speed may be 45 rpm. During the rotation of the drum at the first rotation speed, the washing machine 100 heats air sucked from the inside of the drum to an adequate temperature through the drying unit and transfers the heated air to the inside of the drum.

Then, the washing machine 100 determines whether or not to perform a change from the first heating interval to the second heating interval based on a predetermined condition (S1130).

According to an embodiment, the washing machine 100 may determine whether or not to perform a change from the first heating interval to the second heating interval based on a predetermined length of the first heating interval.

Specifically, once the drying process starts, the washing machine 100 may perform counting from a point in time at which the drying process starts and determine whether or not to perform a change from the first heating interval to the second heating interval based on whether or not a threshold time set as the first heating interval elapses.

According to another embodiment, the washing machine 100 may determine whether or not to perform a change from the first heating interval to the second heating interval based on a dried state of the laundry received in the drum.

Specifically, once the drying process starts, the washing machine 100 measures a weight of the laundry received in the drum. Then, the washing machine 100 may periodically measure the weight of the laundry during the first heating interval to determine whether or not to perform a change from the first heating interval to the second heating interval based on a degree of change from an initial value which is measured in advance to a currently measured value.

According to such an embodiment, in a case where it is determined that an event of the interval change from the first heating interval to the second heating interval occurs in the first heating interval, the washing machine 100 rotates the drum by changing the rotation speed of the drum from the first rotation speed to the second rotation speed (S1140). During the rotation of the drum at the second rotation speed, the washing machine 100 heats the air sucked from the inside of the drum to an adequate temperature through the drying unit and transfers the heated air to the inside of the drum.

Then, the washing machine 100 determines whether or not the drying operation in the entire heating interval is completed depending on whether or not the predetermined threshold time related to the entire heating interval including the first and second heating intervals elapses.

In a case where it is determined that the drying operation corresponding to the heating interval is completed, the washing machine 100 performs the drying operation corresponding to the cooling interval and then terminates the entire drying process (S1160). Specifically, in a case where it is determined that the drying operation corresponding to the heating interval is completed, the washing machine 100 terminates the heating operation of heating the air. Then, the washing machine 100 may rotate the drum at the second rotation speed during the remaining time interval, excluding a time interval during which the process corresponding to the heating interval in the entire drying process is performed.

Hereinafter, a method of cleaning the filter unit filtering foreign matter including lint in the washing machine 100 will be described in detail.

Figure 12:
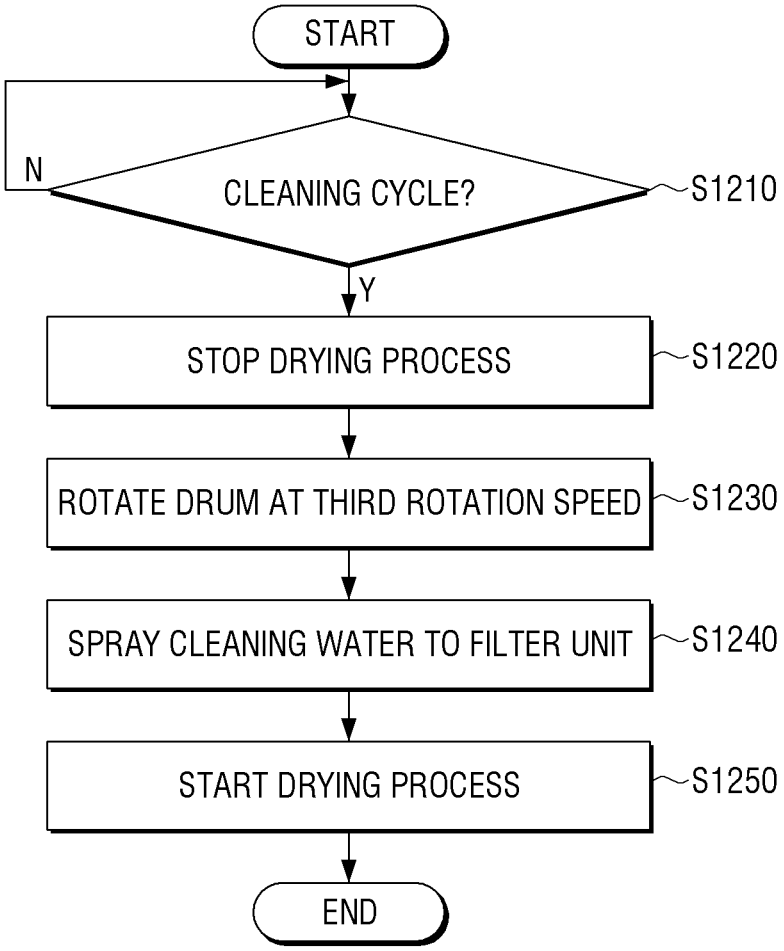
FIG. 12 is a flowchart illustrating a method of cleaning the filter unit in the washing machine according to an embodiment of the disclosure.

FIG. 12 is a flowchart illustrating a method of cleaning the filter unit in the washing machine according to an embodiment of the disclosure.

As illustrated in FIG. 12, in a case where it is determined that the cleaning cycle for the filter unit starts during the drying process, the washing machine 100 stops the drying process (S1210 and S1220). Specifically, once the cleaning cycle for the filter unit filtering the lint starts, the washing machine 100 controls the drying unit such that at least one of the suction unit or the heater unit is turned off, the suction unit sucking the air in the drum and the heater unit heating the sucked air.

Then, the washing machine 100 rotates the drum at the third rotation speed (S1230). Accordingly, the drum may rotate at the third rotation speed during the cleaning interval. Here, the third rotation speed may be a rotation speed higher than the second rotation speed described above, and may be 80 rpm according to an embodiment. As the drum rotates at 80 rpm during the cleaning interval, it is possible to prevent the cleaning water sprayed to the filter unit from permeating into the laundry received in the drum.

When the drum rotates at the third rotation speed, the washing machine 100 sprays the cleaning water to the filter unit through the cleaning unit for the predetermined threshold time (S1240). Here, the predetermined threshold time may be 1 second. As a result, the foreign matter including the lint, filtered by the filter unit may be removed by the cleaning water sprayed through the cleaning unit.

After the cleaning water is sprayed to the filter unit for the predetermined threshold time, the washing machine 100 starts the drying process (S1250). Specifically, after the cleaning water is sprayed to the filter unit for the predetermined threshold time, the washing machine 100 rotates the drum by changing the rotation speed of the drum from the third rotation speed to the second rotation speed, and turns on the drying unit. Accordingly, the drum rotates at the second rotation speed, rather than the third rotation speed, and the drying unit may beat the air sucked through the suction unit, using the heater unit, and transfer the heated air to the inside of the drum according to the turn-on command.

Hereinabove, the disclosure has been described with reference to embodiments.

Although the embodiments of the disclosure have been illustrated and described hereinabove, the disclosure is not limited to the above-mentioned specific embodiments, but may be variously modified by those skilled in the art to which the disclosure pertains without departing from the scope and spirit of the disclosure as disclosed in the accompanying claims. These modifications should also be understood to fall within the scope of the disclosure.

The invention claimed is:

1. A washing machine comprising:

a main body a drum disposed in the main body for receiving laundry;

a motor coupled to the drum for rotating the drum;

a drying unit disposed in the main body for supplying air to inside of the drum, the drying unit including a heater and a fan;

a filter unit coupled to the drying unit for filtering lint in air to be supplied to the drying unit, the filter unit including a filter;

a cleaning unit coupled to the filter unit for removing the lint clogged on the filter, the cleaning unit including a spray nozzle for spraying water toward the filter; and a processor configured to;

control the cleaning unit, in a first drying step, to spray water for a predetermined first interval while the drum rotates at a first rotation speed, and the heater and the fan are operated; and control the cleaning unit, in a second drying step, to spray water for a predetermined second interval while the drum rotates at a second rotation speed, and the heater is not operated, and the fan is operated; and wherein the second interval is shorter than the first interval, and the second rotation speed is higher than the first rotation speed.

2. The washing machine as claimed in claim 1, wherein the processor performs the first drying step previous to the second drying step.

3. The washing machine as claimed in claim 1, wherein the first rotation speed is 40 to 45 rpm and the second rotation speed is 50 to 60 rpm.

* * * * *